US006842955B2

(12) United States Patent
Joshi et al.

(10) Patent No.: US 6,842,955 B2
(45) Date of Patent: Jan. 18, 2005

(54) METHOD OF FABRICATING AND TESTING A STORAGE TANK

(75) Inventors: Yatish J. Joshi, South Bend, IN (US); Larry J. Costa, Mishawaka, IN (US); Louise E. Addicott, South Bend, IN (US)

(73) Assignee: GTA Containers, Inc., South Bend, IN (US)

( * ) Notice: Subject to any disclaimer, the term of this patent is extended or adjusted under 35 U.S.C. 154(b) by 0 days.

(21) Appl. No.: 10/675,495

(22) Filed: Sep. 30, 2003

(65) Prior Publication Data

US 2004/0040136 A1 Mar. 4, 2004

(Under 37 CFR 1.47)

Related U.S. Application Data

(62) Division of application No. 09/835,216, filed on Apr. 13, 2001, now Pat. No. 6,648,507.
(60) Provisional application No. 60/198,199, filed on Apr. 19, 2000.

(51) Int. Cl.[7] ..... G01M 19/00
(52) U.S. Cl. ..... 29/407.01; 29/407.05; 29/407.08; 29/455.1; 220/565; 383/66; 383/119; 383/904; 73/40; 73/40.7; 73/49.3; 73/865.8
(58) Field of Search ..... 29/407.01, 407.05, 29/407.08, 412, 455.1; 73/40, 40.7, 45.5, 49.2, 52, 49.3, 865.8; 383/66, 95, 81, 904, 905, 906, 119, 901; 220/565

(56) References Cited

U.S. PATENT DOCUMENTS 1,206,041 A 11/1916 Slataper (List continued on next page.)

FOREIGN PATENT DOCUMENTS

| | | | |
|---|---|---|---|
| FR | 2501648 A | 9/1982 | |
| JP | 60211332 A | * 10/1985 | ..... G01M/3/12 |
| WO | WO 8906624 A | 7/1989 | |

OTHER PUBLICATIONS

Copy of International Search Report in corresponding patent application, dated Nov. 16, 2001, 7 pages.

(List continued on next page.)

*Primary Examiner*—David P. Bryant
*Assistant Examiner*—Jermie E. Cozart
(74) *Attorney, Agent, or Firm*—Baker & Daniels

(57) ABSTRACT

A liquid storage tank and a method of fabricating and testing the liquid storage tank. The tank is collapsible for ease of transportation when not holding a liquid and includes a base portion and a top portion. The base portion has a bottom wall and a frusto-conical sidewall that is sealed to the bottom wall. The top portion is sealed to the sidewall, and has a flexible opening. The opening is linear in the preferred embodiment and is openable to draw liquid from the tank and closable to prevent contaminants from entering the tank. The bottom wall is substantially circular and the top portion includes two substantially semi-circular sections joined and overlapped along the straight edges to form an overlapped region. The sidewall includes generally triangular-shaped sections, and the sections are joined to one another with seams that extend in a slightly helical fashion about the tank. The opening includes a slit in the overlapped region and two L-shaped members. Each L member has a horizontal leg and a vertical leg. The vertical legs are adjacent one another with the slit located therebetween. The horizontal legs are attached to the top portion. The vertical legs have sealed extended ends and include a releasable closing mechanism for opening and closing the opening. The liquid storage tank may be inverted through the opening for ease in cleaning the tank, and the tank may be placed on an incline of up to at least ten degrees with the tank being filled to capacity and wherein no liquid will spill from the opening. A method of pressure testing the tank is provided.

19 Claims, 6 Drawing Sheets

U.S. PATENT DOCUMENTS

| | | | | | |
|---|---|---|---|---|---|
| 2,273,128 | A | | 2/1942 | Madsen et al. | |
| 2,507,939 | A | | 5/1950 | Smith | |
| 2,633,172 | A | | 3/1953 | Treiber | |
| 2,638,951 | A | | 5/1953 | Smith et al. | |
| 2,664,131 | A | | 12/1953 | Miller | |
| 2,730,150 | A | | 1/1956 | Winderwald et al. | |
| 2,754,869 | A | | 7/1956 | Bartels | |
| 2,854,049 | A | | 9/1958 | Wyllie | |
| 2,915,097 | A | | 12/1959 | Lewis | |
| 3,095,206 | A | | 6/1963 | Fresia et al. | |
| 3,117,606 | A | | 1/1964 | Hastings | |
| 3,319,684 | A | | 5/1967 | Calhoun | |
| 3,559,708 | A | | 2/1971 | Cook | |
| 3,946,780 | A | | 3/1976 | Sellers | |
| 3,960,192 | A | | 6/1976 | Convain | |
| 3,965,953 | A | | 6/1976 | Becker et al. | |
| 3,978,901 | A | | 9/1976 | Jones | |
| 3,998,304 | A | | 12/1976 | Edgerton, Jr. et al. | |
| 4,085,886 | A | | 4/1978 | Nishioka | |
| 4,124,049 | A | | 11/1978 | Yamaguchi | |
| 4,136,725 | A | | 1/1979 | Phillips et al. | |
| 4,383,564 | A | | 5/1983 | Hoie | |
| 4,468,812 | A | | 8/1984 | Grosvenor | |
| 4,503,560 | A | | 3/1985 | Bourne | |
| 4,573,508 | A | | 3/1986 | Knaus | |
| 4,597,425 | A | | 7/1986 | Tally | |
| 4,640,328 | A | | 2/1987 | Arney | |
| 4,689,987 | A | * | 9/1987 | Aarts | 73/49.3 |
| 4,768,887 | A | | 9/1988 | Kimura | |
| 4,865,096 | A | | 9/1989 | Schober et al. | |
| 4,890,439 | A | | 1/1990 | Smart et al. | |
| 4,904,093 | A | | 2/1990 | Woods et al. | |
| 5,302,029 | A | | 4/1994 | Weber et al. | |
| 5,333,492 | A | * | 8/1994 | Aarts | 73/49.3 |
| 5,368,395 | A | | 11/1994 | Crimmins | |
| 5,429,437 | A | | 7/1995 | Shaw et al. | |
| 5,499,743 | A | | 3/1996 | Blumenkron | |
| 5,524,781 | A | | 6/1996 | Podd et al. | |
| 5,622,277 | A | | 4/1997 | Van Giezen et al. | |
| 5,964,369 | A | | 10/1999 | Greene et al. | |
| 6,021,915 | A | | 2/2000 | Shimozono et al. | |
| 6,056,438 | A | | 5/2000 | Bradley | |

OTHER PUBLICATIONS

"Purchase Description: Tank, Fabric, Collapsible, Self–Supporting, Open Top, Water Storage, 3000 Gallons", May 18, 1998, 3 pages.

"Erection/Operation Manual: GTA Water Well", Jun. 28, 1999, 8 pages.

Military Specification, "Tank, Fabric, Collapsible, Air Column Supported, Open Top, Water Storage 3000 Gallons", Feb. 9, 1989, 35 pages.

Purchase Description, "Tank, Fabric, Collapsible, Self–Supporting, Open Top, Water Storage, 3000 Gallons", Jun. 16, 1997, 20 pages.

* cited by examiner

METHOD OF FABRICATING AND TESTING A STORAGE TANK

This Application claims priority from non-provisional U.S. application Ser. No. 09/835,216, which was filed on Apr. 13, 2001, now U.S. Pat. No. 6,648,507, which in turn claimed priority from U.S. Provisional Application No. 60/198,199 filed Apr. 19, 2000, both of which are incorporated by reference as if fully rewritten herein.

BACKGROUND OF THE INVENTION

This invention relates to collapsible liquid storage tanks, and in particular, it relates to a frameless collapsible liquid storage tank having a closeable opening at the top of the tank.

It is often desirable to have a container or storage tank capable of holding a liquid such that when there is no liquid in the container it may be collapsed or folded for ease of transportation and storage. Collapsible liquid containers have been around for some time and encompass a variety of designs. Examples of early collapsible containers are shown in U.S. Pat. No. 2,664,131 to Miller and U.S. Pat. No. 2,754,869 to Bartels, herein incorporated by reference. Miller and Bartels disclose collapsible buckets or pails having sidewalls and bottoms of a flexible moisture impervious material. Both Miller and Bartels also include open tops and rigid reinforcing rings at the upper and lower ends of the sidewalls. The reinforcing rings aid in the stability of the container and assist in maintaining the container shape while being filled with a liquid, the hydrostatic pressure of the liquid aids in maintaining the containers in an upright non-collapsed position. It is also believed the frusto-conical shape shown by Bartels wherein the bottom of the container is larger than the top aids in maintaining the shape and stability of the tank because the liquid contained therein employs an upward pressure on the sidewall and reduces the effective horizontal vector of the hydrostatic pressure against the sidewall.

Another form of a collapsible container is found in U.S. Pat. No. 5,622,277 to Van Giezen et al., herein incorporated by reference. The collapsible container in Van Giezen has a collapsible sac which is supported by a rigid frame. The frame can be folded or disassembled for transportation and/or storage. A drawback, however, to a collapsible tank with rigid support frames is that the support frames even in the folded or disassembled state still occupy a substantial space and significantly add on the bulk and weight of the container.

Another type of collapsible liquid storage tanker container is the tube or pillow type such as is found in U.S. Pat. No. 4,573,508 to Knaus; U.S. Pat. No. 4,597,425 to Tally; and U.S. Pat. No. 5,499,743 to Blumenkron, all herein incorporated by reference. The containers found in Knaus, Tally, and Blumenkron are relatively light weight and compactable when not filled with a liquid as they have no frame or rigid support rings. These containers are formed of a flexible fiber reinforced elastomeric material and have inlets or nozzles at the sides for filling and draining purposes. One of the benefits of tube or pillow containers is that they provide a good environmental seal to keep contaminants from either entering or leaving the tank. A drawback of this type of container is that the size of the valves or nozzles are relatively small and do not provide for quickly filling or draining of the tank. In addition, as the interior of the tanks are sealed, except for the nozzle or valve, cleaning the inside of the tanks is difficult, and there is no access for wiping down the interior of the tank during cleaning.

Another example of a collapsible tank is found in U.S. Pat. No. 5,964,369 to Greene, et al, herein incorporated by reference. The container disclosed by Greene is somewhat similar to the tube or pillow containers discussed above in that it has a valve for filling and draining it, and wherein the valve is supported by a rigid ring. The patent to the Greene, though, has the valve located at the top of the tank as opposed to the side. However, the container disclosed by Greene still has the same drawbacks as the tube Containers regarding ease of filling, draining and cleaning.

An alternative to the tube tanks discussed above, is open top water tanks such as disclosed in U.S. Pat. No. 5,429,437 to Shaw et al, and U.S. Pat. No. 6,021,915 to Shimozono et al, herein incorporated by reference. These containers are somewhat similar to the pails disclosed by Miller and Bartels except on a larger scale. As these tanks have an open top, they provide the ease for filling, draining, and cleaning not found in the tube tanks. However, these tanks have a drawback in that as the top is open, any liquid in the tank is exposed to the environment and contamination therefrom. Another drawback of these containers is that they require a stiffening or floating member at the top of the sidewall and/or one at the bottom of the sidewall. These members may be made from metal, stiff plastic, or a floating foam such as polyethylene foam. The stiffening members add bulk and weight to the tank when it is not holding a liquid and is in its collapsed state.

In order to provide a minimal environmental barrier for open top tanks, it has been known to equip the tanks with a cover that is held down by straps or ties. The drawback to this type of cover is that it still does not provide an adequate environmental seal, especially in adverse or windy conditions when the top will be subject to blowing and the ties may be torn away. Also, in order to overcome the weight and storage drawbacks of a rigid or floating ring at the upper sidewall, it has been known to provide an air inflated ring about the top sidewall. The inflatable collar allows the tank to be filled without spilling over the sides as the collar floats and rises with the liquid level. However, inflatable collars have the drawback that they require inflation devices to be carried with the container for inflation of the collar and increase the complexity and cost of the storage tank. Furthermore, the tank is rendered useless if a leak is developed in the collar.

As such, it is the object of this invention to provide a tank combining benefits of both the open top tanks discussed above plus the tube and pillow tanks without the drawbacks associated with either tank. In particular, it is an object of the invention to provide a tank that is openable from the top being easily filled and drained. It is another object of the invention to provide a tank that may be easily cleaned and wiped down on the interior of the tank and is suitable for holding potable liquids.

It is also an object of the invention to provide a frameless tank having no support frame, rigid or floating support members at either the upper or lower ends of the sidewalls thereof. It is a further object of this invention to provide a tank that can be easily filled without spillage and has no inflatable member. It is also an object of the invention that the tank be capable of being used on a surface having an incline of at least 10 degrees and being filled with a liquid without spillage.

Lastly, it is an object of the invention to provide a frameless collapsible liquid storage tank being openable at the top, yet providing an effective barrier against environmental contamination.

BRIEF SUMMARY OF THE INVENTION

It is a feature of the invention to provide a liquid storage tank that is collapsible for ease of transportation when not holding a liquid. The tank includes a base portion and a top portion. It is another feature of the invention that the base portion has a bottom wall and a frusto-conical sidewall that is sealed to the bottom wall. The top portion is sealed to the sidewall, and has a flexible opening. The opening is linear in the preferred embodiment and is openable to draw liquid from the tank and closable to prevent contaminants from entering the tank.

It is also a feature of the invention that the bottom wall is substantially circular, and the top wall preferably includes two substantially semi-circular sections joined and overlapped along the straight edges to form an overlapped region.

Another aspect of the invention is that the sidewall includes generally triangular-shaped sections, and the sections are joined to one another at seams. The seams extend in a slightly helical fashion about the tank.

It is a further feature of the invention that the liquid storage tank includes at least one nozzle or fitting in a lower portion of said sidewall for filling and draining said tank.

An additional aspect of the invention is that the opening is located in the overlapped region of the top semi-circular sections for providing reinforcement to the opening.

Also, it is a feature of the invention that the opening includes a slit in the overlapped region and two L-shaped members. Each L member has a horizontal leg and a vertical leg. The vertical legs are adjacent one another with the slit located between them. The horizontal legs are attached to the top portion.

Another feature of the invention is that the vertical legs of the L-shaped members are sealed to one another at extended ends of the members.

Additionally a feature of the invention is that a portion of the vertical legs between the sealed extended ends includes a releasable closing mechanism for opening and closing the opening. The tank also includes a cover foldable about and releasably attachable to the vertical legs.

A different feature of the invention is that the liquid storage tank may be inverted through the opening for ease in cleaning the tank.

Another feature of the invention is that the liquid storage tank may be placed on an incline of up to at least ten degrees with the tank being filled to capacity and wherein no liquid will spill from the opening.

It is an added feature of the invention to provide a method for fabricating and testing a liquid storage tank that includes the steps of providing a fabric reinforced elastomeric material, cutting a bottom wall, a sidewall, and a top wall from said material, sealing the bottom wall to the sidewall, sealing the sidewall together with at least one seam, sealing the top wall to the sidewall, pressurizing said tank and checking the tank for leaks when pressurized.

It is another feature of the invention that the sealing is accomplished using a radio frequency method.

It is also a feature of the invention to include a step of sealing the seams of the tank with a sealant tape.

It is also a feature of the invention to provide a method for fabricating and testing a liquid storage tank that includes the steps of providing reinforcing members on the top wall and cutting a slit in the top wall such that the reinforcing members surround the slit.

Another feature of the invention is to provide a method of fabricating and testing a liquid storage tank that includes the steps of providing a cover, folding the cover about the vertical legs and releasably attaching the cover to the vertical legs.

An additional aspect of the invention is to provide a method of fabricating and testing a liquid storage tank wherein the tank is pressurized with air and checked for leaks using a soapy solution. Other features of the invention will become apparent upon reading the detailed description and claims.

DETAILED DESCRIPTION OF THE PREFERRED EMBODIMENT

Figure 1:
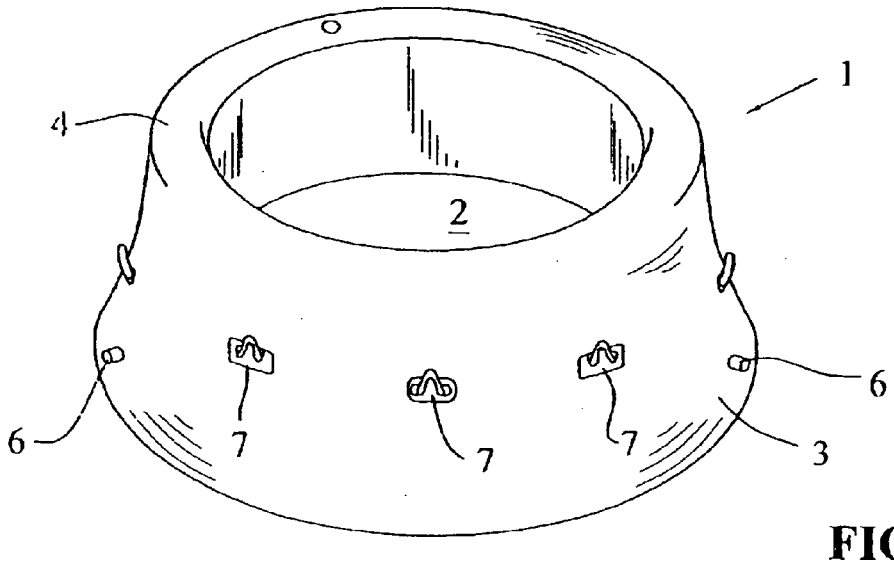
FIG. 1 (PRIOR ART)
FIG. 1 is a perspective view of a prior art open top collapsible tank.
Figure 2:
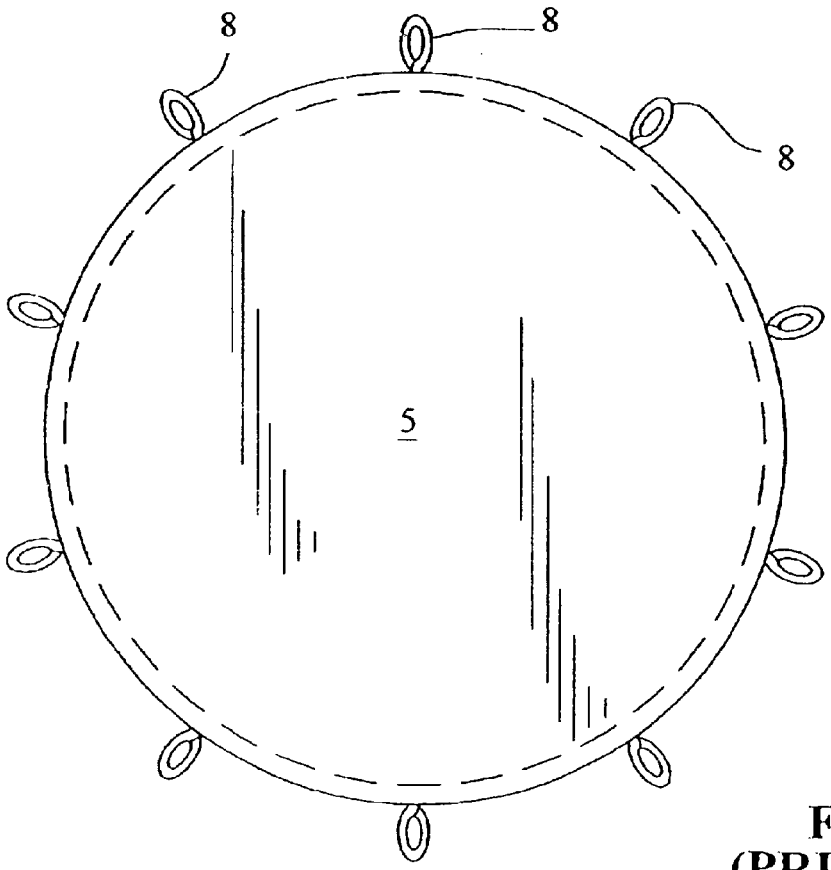
FIG. 2 (PRIOR ART)
FIG. 2 is a top view of a prior art cover for the tank of FIG. 1.

Referring now to FIGS. 1 and 2, an example of a prior art liquid storage tank is generally indicated by 1. The prior art liquid storage tank includes a bottom wall 2, a sidewall 3 and a cover 5. Bottom wall 2 and sidewall 3 are made of fiber reinforced elastomeric material, which may be suitable for storing a potable liquid.

Sidewall 3 has an upper rim 4 that includes a floating or reinforcing member (not shown). In the alternative, upper rim 4 may include an inflatable section such that when tank 1 is filled with a liquid, the inflatable rim floats and rises to prevent the liquid from spilling over rim 4. Nozzles 6 are located in sidewall 3 and can be used for filling or draining the tank. Metal grommets 7 are affixed to sidewall 3 so that cover 5 may be attached to tank 1 by hooking straps 8 on the grommets.

Figure 3:
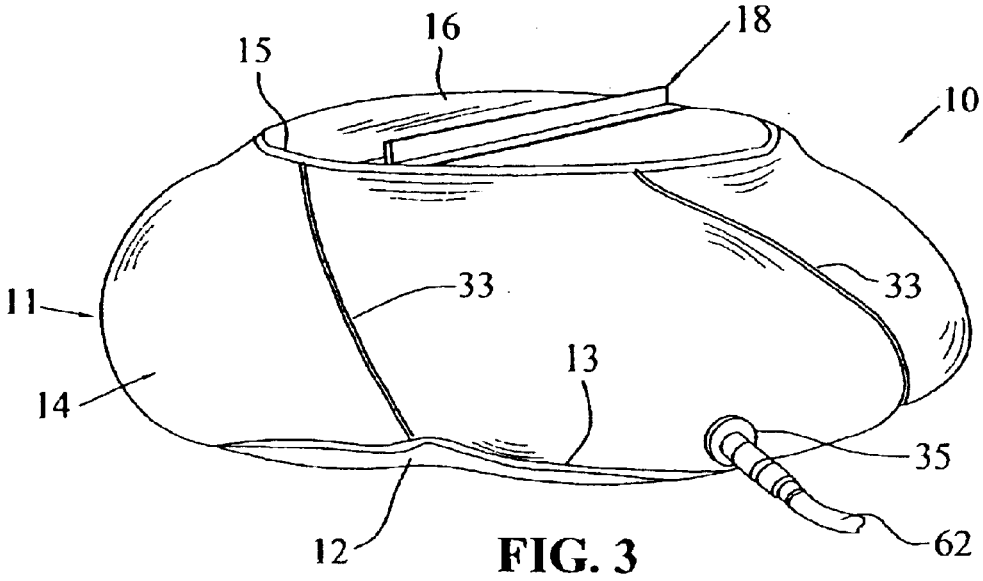
FIG. 3 is a perspective view of the collapsible liquid storage tank of the present invention filled with a liquid.

Now referring to FIG. 3, the preferred embodiment of a liquid storage tank of the present invention is shown generally as 10. The liquid storage tank 10 includes a base portion generally indicated as 11 including a bottom wall 12 and a sidewall generally indicated by 14. Tank 10 also has a top wall or portion 16 and a linear opening generally indicated as 18. Joining bottom wall 12 to sidewall 14 is a seam 13 and joining sidewall 14 to top wall 16 is a seam 15.

Figure 4:
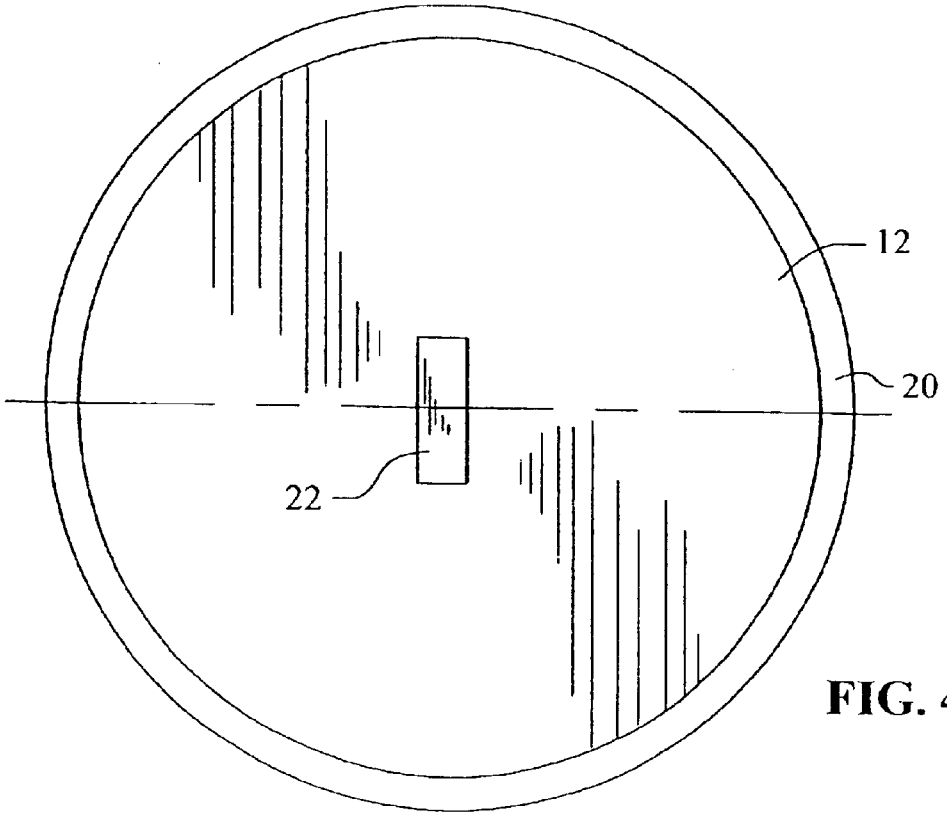
FIG. 4 is a top view of the bottom wall of the tank of FIG. 3 prior to assembly.

Now referring to FIG. 4, a top view of bottom wall 12 is shown prior to incorporating the wall into storage tank 10. Bottom wall 12 includes an outer rim 20 which is incorporated in seam 13 when storage tank 10 is assembled. A flexible handle 22 is attached to and located in approximately the center of the bottom wall.

Figure 5:
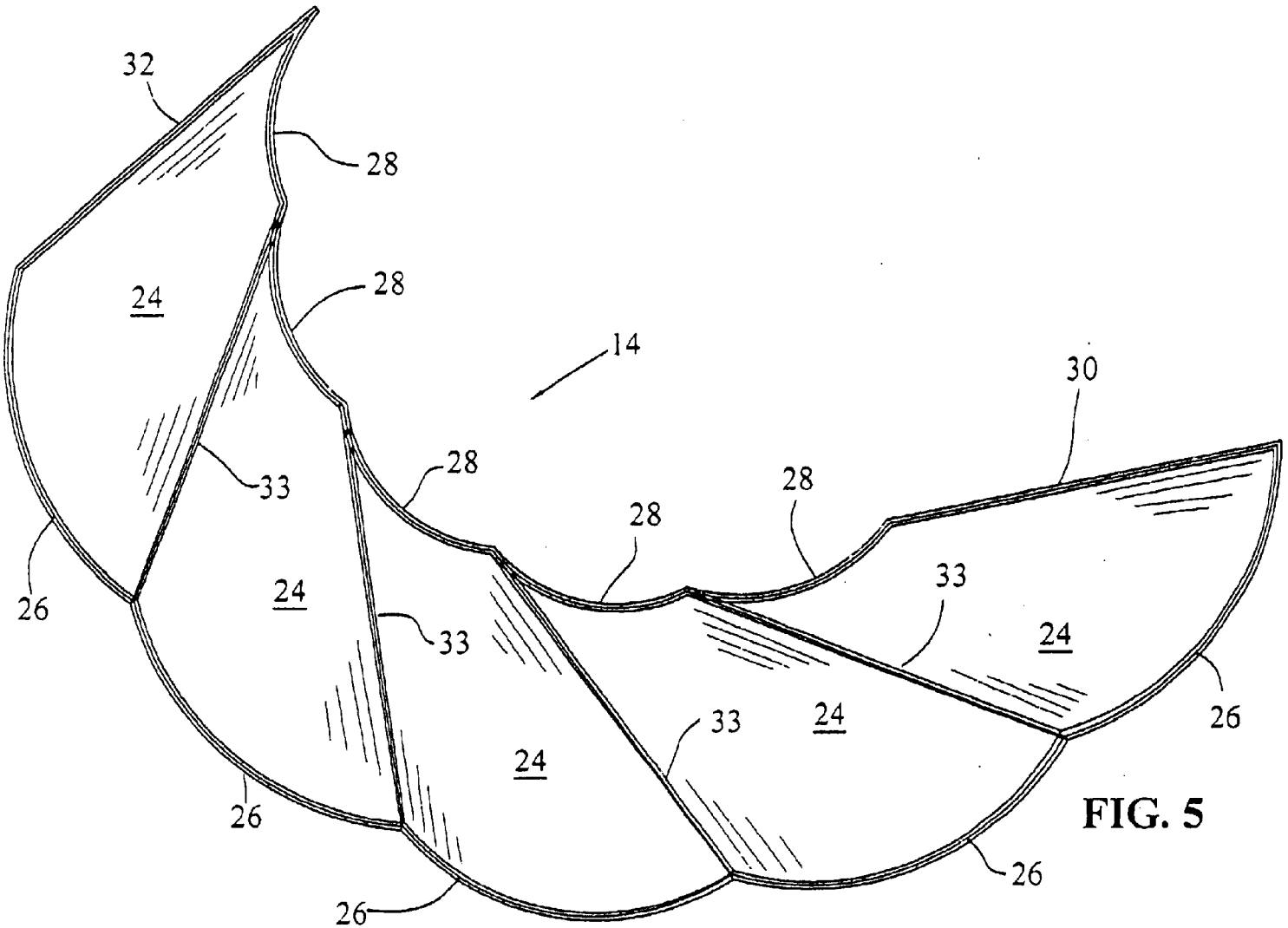
FIG. 5 is a laid out top view of the sidewall sections of the tank of FIG. 3 prior to assembly to the bottom and top walls.

Referring to FIG. 5, a laid out view of sidewall 14 is depicted showing that the sidewall consists of several generally triangular-shaped sections 24, each of said sections having a convex base edge 26, a concave top edge 28, a first side edge 30 and a second side edge 32. Between adjacent sections 24 of sidewall 14 are seams 33 wherein a first side edge 30 of one section 24 is attached to a second side edge 32 of another section 24. Sidewall 14 also includes at least one nozzle 35. In the preferred embodiment, two nozzles are used, one of each of said nozzles being located on opposite sides of storage tank 10 and towards the bottom of sidewall 14.

Figure 6:
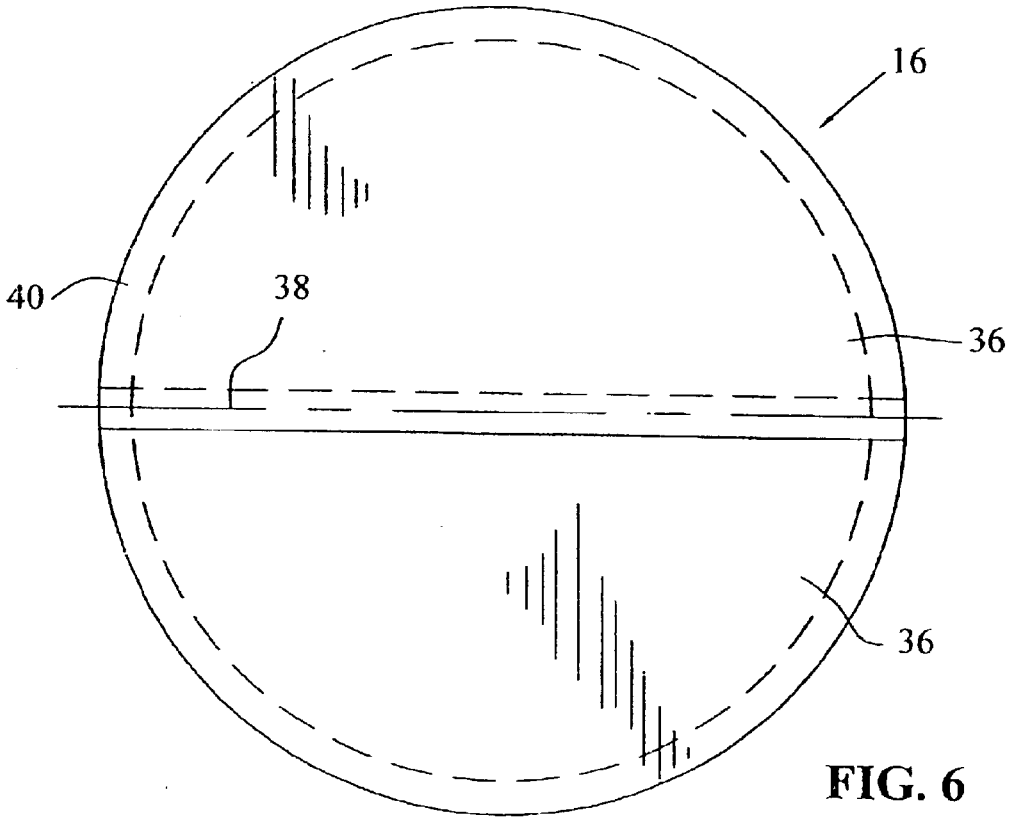
FIG. 6 is a top view of the top wall of the tank of FIG. 3 prior to assembly into the tank.

The preferred embodiment of top wall 16 is depicted in FIG. 6. Top wall 16 includes two semi-circular sections 36 having an overlapped region 38 along the straight edges of said sections. Top wall 16 also includes an outer attachment edge 40 for attaching to sidewall 14 at seam 15.

Figure 8:
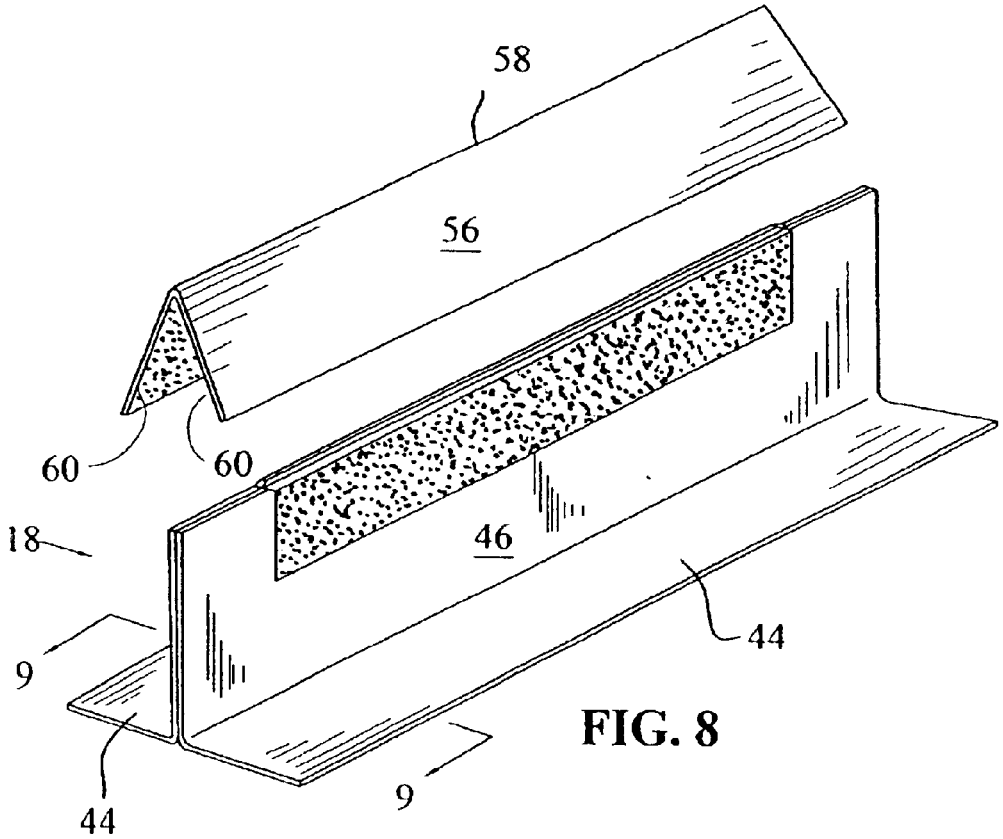
FIG. 8 is a perspective view of the opening of the tank of FIG. 3 in the closed position and also showing a cover for covering the opening.
Figure 7:
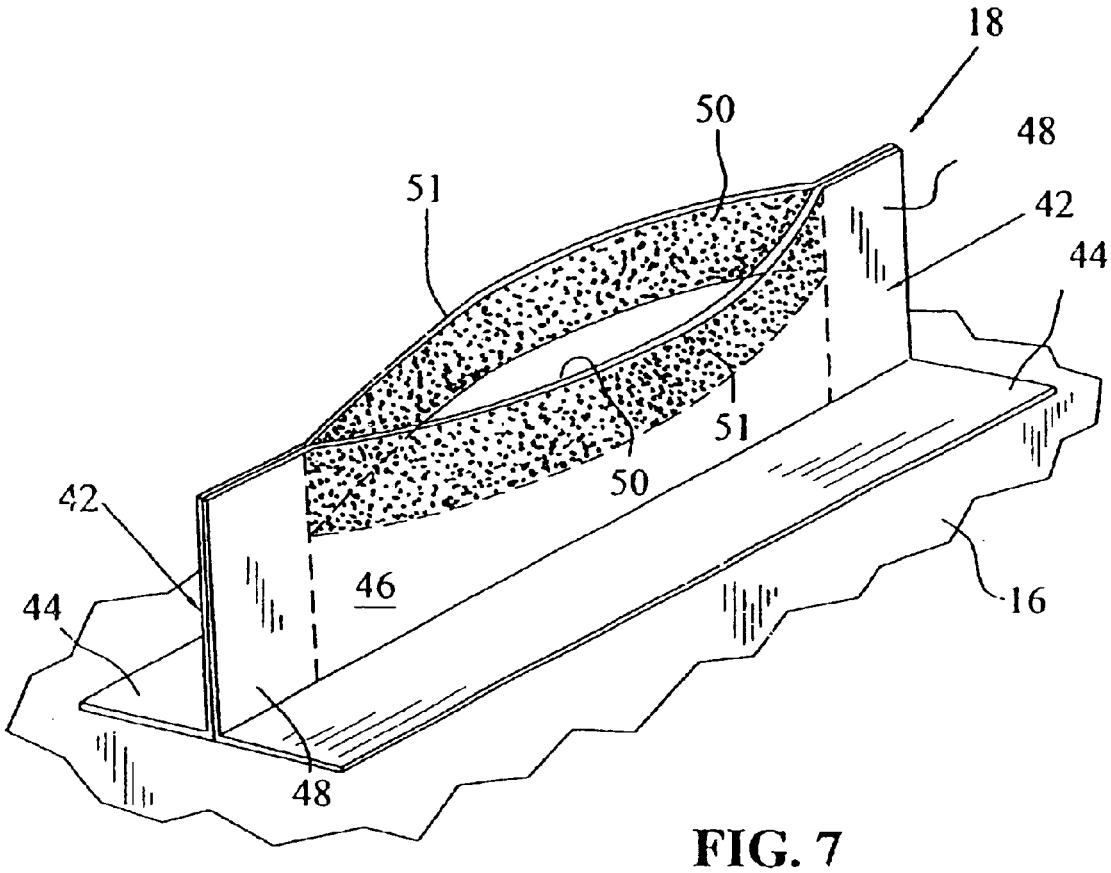
FIG. 7 is a perspective view of the top opening of the tank of FIG. 3 shown in the open position.
Figure 9:
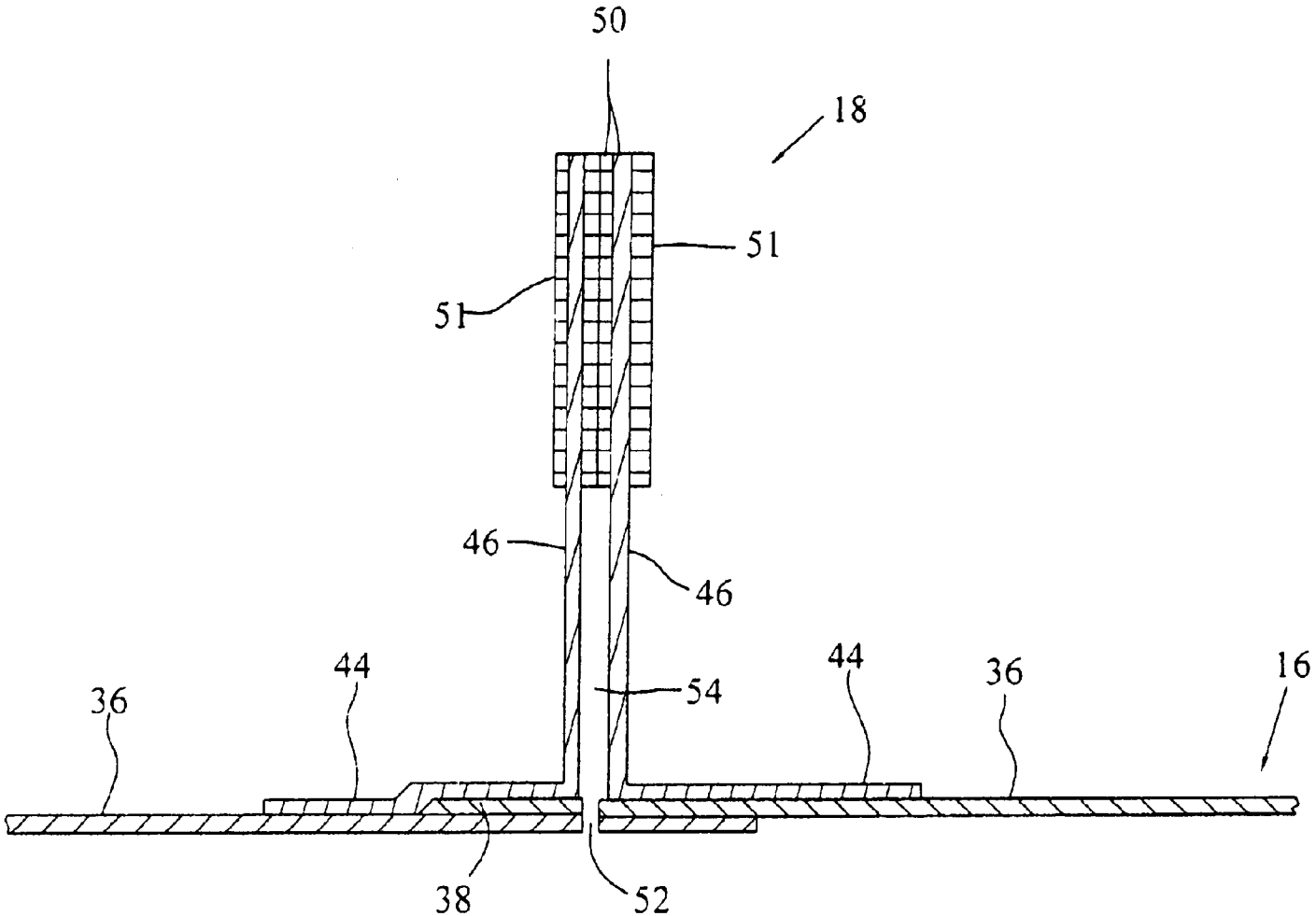
FIG. 9 is a cross section of the opening taken along line 9—9 in FIG. 8.

The details of opening 18 are depicted in FIGS. 7–9. Opening 18 includes a pair of L-shaped members generally indicated as 42, each of said L-shaped members having a horizontal leg 44 and a vertical leg 46. Said L-shaped members are located in a back-to-back manner such that vertical members 46 are adjacent or juxtaposed one another and horizontal legs 44 are attached to top wall 16. Vertical legs 46 have extended ends 48, where said vertical legs are attached or fixed together. Strips of hook and loop material 50 and 51 are attached at the upper ends of vertical legs 46 such that a strip is mounted on both sides of each vertical leg 46. It should be noted that the strips 50 are mounted on the sides of vertical legs 46 adjacent one another, and therefore would be mating strips such that one strip 50 would consist of loops and the other strip 50 of hooks, thereby enabling opening 18 to be closed and opened. Both of strips 51 consist of loop material. Opening 18 also includes a slit 52 in the overlapped region 38 of top 16 and a pathway 54 defined by the area between adjacent vertical legs 46. Slit 52 and pathway 54 span between sealed extended ends 48.

A cover 56 is provided to cover opening 18. Said cover has a hinge or fold 58 and is foldable about said hinge. On a side of cover 56 beneath the fold 58 is a pair of hook material strips 60 attached thereto.

Having described the component parts of liquid storage tank 10, the assembly of said parts will now be described in further detail. In the preferred embodiment, bottom wall 12, sidewall 14, top wall 16, L-shaped members 42 and cover 56 are all made from a fiber reinforced elastomeric material, which is also suitable for potable liquids. An example of a suitable material is DuPont Elvaloy TM which is an ethylene based polymer with reinforced synthetic fibers. Any suitable method known in the art may be used for cutting the component parts of tank 10 from the elastomeric material. Once the parts of storage tank 10 have been cut to size, they are joined and sealed at seams 13, 15, and 33 using a heat sealing technique. Radio frequency welding has been found to provide an economic and sound method of making the seams; however, other methods which are also well known in the art such as ultrasonic heating, heating with hot air, electrical resistant heat, or other methods may be utilized. It should be noted that with the material employed and joining techniques utilized, no adhesive is required for seams 13, 15, and 33 but may be used for additional assurance of leak resistance. It has been found that a seam overlap width of approximately 1–2 inches provides sufficient strength and leak resistance. After heat sealing the seams, all seams may be covered with a strip of nylon or polyester tape (not shown), also in the preferred range of 1–2 inches in width, for providing additional strength and leak resistance to the seams.

Semi-circular sections 36 of top wall 16 are joined in overlap region 38 using the same radio frequency technique or other methods described above for seams 13, 15, and 33. Likewise, horizontal legs 44 of L-members 42 are sealed to top wall 16 at overlap region 38 in a similar manner. Extended ends 48 of vertical legs 46; however, are joined using a gummy resinous material such as a polyurethane. The polyurethane in the preferred embodiment is a two-part mixture containing a resin and hardener which are well known and hardens upon mixing of the materials. The resin material is also suitable for contact with potable liquids. Also, hook and latch strips 50 and 51 are attached to vertical legs 46 and hook strips 60 are attached to cover 56 using a heat activated adhesive which is preapplied to the hook and latch strips by the manufacturer. It should be noted that it is preferable for both of strips 60 to be of hook type material, thereby rendering that both of strips 51 on the exterior of vertical legs 46 would be of loop material. This configuration allows the longitudinal orientation of cover 56 along opening 18 to be reversed without affecting the ability of the cover to be firmly secured to vertical legs 46. Furthermore, opening 18 is easier to grasp for opening or closing with the loop material on the exterior of vertical legs 46 as opposed to hook material. Although, it should be obvious that strips 60 may consist of loop material and strips 51 may be hook material.

Regarding sections 24 of sidewall 14, it should be understood that the generally triangular shape of said sections results in seams 33 extending at an angle from the vertical or otherwise in a slightly helical fashion about liquid storage tank 10. The preferred angle is 26–30 from the vertical, and it has been found that angling the seams in this manner increases the rigidity and stability of the tank, especially when the tank is placed on an inclined surface. When sealed together, sections 24 form a structure having a generally frusto-conical shape.

Now referring to handle 22, the handle is preferably made from the same material as the body of the tank or another fabric which is suitable with a potable liquid. The handle has ends that are sewn or glued to a larger piece of Elvaloy™ material which in turn is heat sealed or glued to bottom wall 12.

Regarding the attachment of nozzles 35 to sidewall 14, the nozzles are of a rigid construction such as metal or plastic and are bolted to a flange (not shown) on the interior of the tank in a manner that is well known in the art. The nozzles are sealed against leaks using a gasket (not shown). Obviously, sidewall 14 will include holes for the bolts (not shown) and a hole to allow liquid to pass through nozzle 35. Each nozzle 35 is also equipped with a removable cap (not shown) which is attached to the nozzle with threads or a quick connect. The threads or quick connect on the nozzle can also be used to facilitate a hose attachment to fill or drain said tank.

A significant advantage obtained by the preferred assembly of liquid storage tank 10 is that it allows for pressure testing for leaks. Accordingly, slit 52 in top 16 is not cut until after the pressure testing has been completed. Upon completion of all previously described seams and taped reinforcement, the tank is inflated with air that is pumped in through one of the nozzles 35 until a positive pressure is created internal to the tank. Once pressurized, all seams and material of the tank may be checked for leaks using a soapy solution. Any leaks will create a bubbling effect in the solution. Any leaks in the seams may be reheated and sealed or patched with a piece of material of the same type as the balance of said tank. A patch may be heat sealed or adhesively attached. Once the tank has successfully completed pressure testing, slit 54 may be cut by spreading apart vertical legs 46 of L members 42 and accessing and cutting top 16 in the overlapped region 38 through the pulled open pathway 54. It should be evident to one skilled in the art that the above described assembly steps and testing offers a significant advantage over the prior art tank 1 in that the only way to test the prior art tank for leaks is by filling the tank with a liquid.

Having described the component parts and assembly of liquid storage tank 10, the operation of unit will now be described. As evident from the above description, storage tank 10 has no rigid frame or rigid/floating reinforcing members at the top or the bottom of the sidewalls. The only rigid portion of the tank being nozzles 35. This means that storage tank 10 can be folded very compactly for storage and transportation purposes. In addition, the design provides a tank that is relatively light in weight which is another important advantage in the transportation thereof.

When it is desired to fill storage tank 10, it is laid out with bottom wall 12 on the surface which will support the tank. The tank can then be filled with a hose 62 attached to one of the nozzles 35 or opening 18 may be opened so that the tank may be filled from the top. It should be noted that the design of tank 10 is such that when filled to capacity, the liquid column does not rise completely to the top of wall 14; therefore, the upper end of sidewall 14 and top 16 is not stressed by the liquid and thereby rests freely and loosely gathered on the surface of the liquid. The liquid may also be removed from the tank through opening 18 or out of one of the nozzles 35.

Another advantage of the present invention is that as opening 18 and top 16 are made of flexible elastomeric material, vertical legs 46 may be pulled apart to greatly increase the width of pathway 54 and slit 52. The flexible nature of the elastomeric material allows opening 18 to be spread sufficiently that it is easy to draw liquid therefrom. It should also be appreciated that overlapped region 38 and horizontal legs 44, as well as sealed ends 48 of vertical legs 46 serve to reinforce top wall 16 so as to prevent slit 52 from propagating beyond the desired length.

It should be apparent from the above description of tank 10 that the only pathways for liquid to escape from the tank is either through nozzles 35 or through slit 52 and pathway 54 out over the top of vertical legs 46. The design of the present invention; however, is such that opening 18 may be open as shown in FIG. 7 with the tank filled to capacity and no liquid will spill over the top of vertical edges 46. In addition, the tank may be placed on a slope of up to 10 degrees without any spillage through opening 18. It should be noted; however, that if storage tank 10 is to be utilized on a sloped surface, linear opening 18 should be placed transverse to the incline as this assures that the lowest height of pathway 54 from which the liquid would spill is at the highest possible elevation. Furthermore, the loosely gathered material as described earlier at the top of tank 10 allows additional liquid to accumulate on the portion of tank 10 that would be on the downward side of the slope so that the liquid level will not rise above the top of pathway 54.

It should also be obvious that the liquid contained in tank 10 is shielded from environmental contaminants such as rain, dirt, dust, and air-born debris by fastening hook and loop strips 50 in pathway 54 and additional protection may be obtained by folding cover 56 about vertical legs 46 and attaching hook and loop strips 51 and 60 to one another.

When it is desired to clean the interior portion of tank 10, any remaining liquid is removed, cover 56 is removed and opening 18 is opened as described above. Handle 22 can then be reached through opening 18 and pulled such that the tank can be inverted through slit 52 and pathway 54 so that the interior of tank 10 would now be towards the exterior. In this manner, the tank may be wiped down, disinfected, and allowed to thoroughly dry before inverting the tank to the original position for use again.

It will be obvious to one skilled in the art that certain changes may be made to the above preferred embodiment without departing from the scope of the invention. For instance, although the preferred embodiment has a top wall constructed from two semicircular pieces thus having an overlapped region, the top could be constructed from a singular piece or more than two pieces. In addition, the reinforcement on the top to prevent slit 52 from propagating could consist of sections of additional layers of material adhered on either side of top 16. Additional reinforcing material could also be overlaid horizontal legs 44. Furthermore, while the opening is shown to follow a straight line, other designs could be utilized with the present invention such as an X-shaped opening, an S-shaped opening or T-shaped opening. Also, other shapes of opening supports may be substituted for the L-shaped members used in the embodiment shown.

It should also be appreciated that although the preferred embodiment utilizes five or six sidewall sections 24, either more or fewer sections could be used. As a matter of fact, sidewall 14 can be made from a singular piece cut to size and having only one vertical seam. Of course, the angle of the seams from the vertical may also be varied. Also, although one handle 22 is shown located in the center of bottom wall 12, additional handles may be used and located other than centrally to the bottom.

It should also be recognized that although the preferred embodiment utilizes a hook and loop fastening material for closing the opening 18 and attaching cover 56, any suitable fastener method may be employed, such as snaps, zippers, string ties, clips, etc.

While the invention has been taught with specific reference to these embodiments, someone skilled in the art will recognize that other changes can be made in form and detail without departing from the spirit and the scope of the invention. The described embodiments are to be considered in all respects as illustrative and not restrictive. The scope of the invention is, therefore, indicated by the following claims rather than by the description.

What is claimed is:

1. A method of fabricating and testing a liquid storage tank comprising the steps of providing a fabric, cutting a base portion and a top portion from said fabric, said base portion including a sidewall and a bottom wall, said sidewall having a generally frusto-conical shape and including six generally triangular-shaped sections, sealing the bottom wall to the sidewall and sealing the triangular-shaped sections to one another to create seams therebetween extending in a slightly helical fashion about said tank, sealing the base portion to the top portion, pressurizing said tank and checking said tank for leaks when pressurized.

2. The method of fabricating and testing a liquid storage tank as set forth in claim 1, wherein said sealing is accomplished by radio frequency sealing.

3. The method of fabricating and testing a liquid storage tank as set forth in claim 1, including the step of reinforcing sealing seams of the tank with a sealant tape.

4. The method of fabricating and testing a liquid storage tank as set forth in claim 1, wherein said tank is pressurized with air and checked for leaks using a soapy solution.

5. A method of fabricating and testing a liquid storage tank comprising the steps of providing a fabric, cutting a base portion and a top portion from said fabric, sealing the base portion to the top portion, pressurizing said tank, checking said tank for leaks when pressurized, providing two L-shaped members each having a horizontal leg and a vertical leg and sealing said horizontal legs to said top portion so that said vertical legs are juxtaposed one another.

6. The method of fabricating and testing a liquid storage tank as set forth in claim 5, including the step of sealing said vertical legs to one another at extended ends of said L-shaped members.

7. The method of fabricating and testing a liquid storage tank as set forth in claim 5, including the step of cutting an opening in the top portion of said tank between the vertical legs of said L-members and between said sealed ends thereof after said pressurizing step has been completed.

8. The method of fabricating and testing a liquid storage tank as set forth in claim 7, including the step of providing a releasable closure means between said vertical legs for releasably closing said opening.

9. The method of fabricating and testing a liquid storage tank as set forth in claim 8, including the steps of providing a cover, folding said cover about said vertical legs and releasably attaching said cover to said vertical legs.

10. A method for fabricating and testing a liquid storage tank comprising the steps of providing a fabric, cutting a base portion and a top portion from said fabric, sealing the base poriton to the top portion, pressurizing said tank, checking said tank for leaks when pressurized, reinforcing the top portion with a flexible support member, and cutting an opening through the flexible support member and top portion after said pressurizing step has been completed.

11. A method of fabricating and testing a liquid storage tank comprising the steps of providing a fabric suitable for containing potable liquids, cutting and sealing the fabric to form said storage tank, pressurizing the tank, checking the tank for leaks when pressurized, and cutting an opening in said storage tank after said pressurizing and checking for leaks steps have been completed.

12. The method of fabricating and testing a liquid storage tank as set forth in claim 11, including the step of reinforcing sealing seams of the tank with a sealant tape.

13. The method of fabricating and testing a liquid storage tank as set forth in claim 11, including the step of reinforcing said storage tank where the opening is cut.

14. The method of fabricating and testing a liquid storage tank as set forth in claim 13, including the step of forming a flexible support about said opening to form a pathway that extends above a top wall of said storage tank.

15. The method of fabricating and testing a liquid storage tank as set forth in claim 14, wherein said flexible support includes a pair of L-shaped members, each having a horizontal leg and a vertical leg.

16. The method of fabricating and testing a liquid storage tank as set forth in claim 15, wherein said vertical legs are adjacent one another extending along opposite sides of said opening, and said horizontal legs are sealed to said top wall of said storage tank.

17. The method of fabricating and testing a liquid storage tank as set forth in claim 16, including the step of sealing said vertical legs to one another at extended ends of said L-shaped members.

18. The method of fabricating and testing a liquid storage tank as set forth in claim 17, including the steps of providing a releasable closure means between said vertical legs for releasably closing said opening, providing a cover, folding said cover about said vertical legs, and releasably attaching said cover to said vertical legs.

19. A method of fabricating and testing a liquid storage tank comprising the steps of providing a fabric suitable for holding a potable liquid, cutting a bottom wall, a side wall, and a top wall from said fabric, sealing said bottom wall to said side wall and said side wall to said top wall to form said storage tank, cutting a flexible linear opening in said top wall, and forming a flexible support about said opening to form a pathway that extends above said top wall of said tank.

* * * * *

UNITED STATES PATENT AND TRADEMARK OFFICE

CERTIFICATE OF CORRECTION

PATENT NO. : 6,842,955 B2
DATED : January 18, 2005
INVENTOR(S) : Yatish J. Joshi et al.

It is certified that error appears in the above-identified patent and that said Letters Patent is hereby corrected as shown below:

Column 9,
Line 27, delete "poriton" and insert -- portion --

Signed and Sealed this

Twenty-ninth Day of March, 2005

JON W. DUDAS
*Director of the United States Patent and Trademark Office*